US006268841B1

(12) United States Patent
Cairns et al.

(10) Patent No.: US 6,268,841 B1
(45) Date of Patent: Jul. 31, 2001

(54) DATA LINE DRIVER FOR A MATRIX DISPLAY AND A MATRIX DISPLAY

(75) Inventors: Graham Andrew Cairns, Cutteslowe; Michael James Brownlow, Sandford on Thames; Andrew Kay, Oxford, all of (GB)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/226,737

(22) Filed: Jan. 7, 1999

(30) Foreign Application Priority Data

Jan. 9, 1998 (GB) ..... 9800330

(51) Int. Cl.[7] ..... G09G 3/36
(52) U.S. Cl. ..... 345/98; 345/100
(58) Field of Search ..... 345/100, 87, 94, 345/98, 101, 55, 208

(56) References Cited

U.S. PATENT DOCUMENTS 5,061,920 * 10/1991 Nelson ..... 345/100

FOREIGN PATENT DOCUMENTS

| | | |
|---|---|---|
| 0 483 972 A2 | 9/1991 | (EP) . |
| 0 731 440 A1 | 2/1996 | (EP) . |
| 0 837 446 A1 | 10/1997 | (EP) . |
| 2 698 202 A1 | 11/1992 | (FR) . |
| 2273194 | 6/1994 | (GB) . |

* cited by examiner

*Primary Examiner*—Dennis-Doon Chow
(74) *Attorney, Agent, or Firm*—Renner, Otto Boisselle & Sklar

(57) ABSTRACT

A data line driver is provided for driving M data lines of a matrix display such as a liquid crystal display. The driver comprises x data line circuits whose inputs are connected to a common input for receiving a serial image signal, where x is less than M. Each of the data line circuits comprises a store for storing one picture element of image data at a time, a multiplexer for storing in the store in sequence image data for m picture elements from at least part of a line of image data, where m is greater than one, and a demultiplexer for directing a line signal corresponding to the image data stored in the store to each of m of the M data lines in sequence.

18 Claims, 13 Drawing Sheets

| Column driver | Column driver |
|---|---|
| t[n-5] | [n] |
| t[n-4] | [n-9] |
| t[n-3] | [n+3] |
| t[n-2] | [n+3] |
| t[n-1] | [n-6] |
| t[n] | [n] |
| t[n+1] | [n+6] |
| t[n+2] | [n+3] |
| t[n+3] | [n+3] |
| t[n+4] | [n+9] |
| t[n+5] | [n) |

5 pixel periods (5/fMN) between successive column driver operations

DATA LINE DRIVER FOR A MATRIX DISPLAY AND A MATRIX DISPLAY

TECHNICAL FIELD OF THE INVENTION

The present invention relates to a data line driver for a matrix display and to a matrix display including such a driver. The display may, for example, be of the thin film transistor (TFT) active matrix liquid crystal display (AMLCD) type and the driver may be integrated monolithically using silicon-on-insulator (SOI) technology.

DISCUSSION OF THE RELATED ART

FIG. 1 of the accompanying drawings illustrates a typical known type of active matrix display, for instance as disclosed by Lewis et al "Driver Circuits for AMLCDs", Journal of the Society for Information Display, pages 56–64, 1995. The display comprises an active matrix 1 of N rows and M columns of picture elements (pixels). The M columns of pixels have data lines which are connected to a data line driver 2 whose input 3 receives serial image data to be displayed. The rows of pixels are connected to scan lines which are connected to a scan line driver 4. The scan line driver 4 supplies scanning or strobe signals for controlling the refreshing of the pixels with the image data.

The lower part of FIG. 1 illustrates to an enlarged scale part of the active matrix 1 showing the individual pixels. Each pixel has a pixel electrode 5 controlled by a thin film transistor 6. Each transistor 6 has a gate connected to the common row scan line such as 7 and a source connected to a common column data line such as 8. The drain of the transistor 6 is connected to the electrode 5.

In order to refresh the image data displayed by each pixel, the appropriate voltage is applied to the data line 8 so as to be present at the source of the pixel transistor 6. The scan line driver 4 supplies a strobe pulse with the appropriate timing via the scan line 7 to the gate of the transistor 6 so that the transistor is switched from its non-conducting state to its conducting state. The charge from the data line is thus transferred to the pixel storage capacitance until the voltage on the electrode 5 is substantially equal to the voltage supplied by the data line driver 2 to the corresponding data line. When refreshing of the pixel has been completed, the strobe signal is removed by the driver 4 so that the transistor 6 returns to its non-conducting state until a further refresh cycle for the pixel takes place.

A display of the type shown in FIG. 1 may be used with a point-at-a-time driving scheme, for instance in the case of an analogue display of small size and low pixel resolution. In this case, the driver 2 comprises a respective pair of complimentary sampling transistors forming a transmission gate connected between each data line 8 and the input 3. A shift register controls conduction of the transmission gates such that only one gate at a time is conducting. An analogue video signal representing one row or line of image data to be displayed is supplied to the input 3 and the corresponding row of the matrix 1 is enabled by the scan line driver 4 applying a strobe signal to the corresponding scan line 7. Each of the transmission gates of the data line driver 2 is enabled in turn by the shift register of the driver 2 in synchronism with the image data so that the pixels of the enabled line or row are refreshed one at a time in sequence.

When the line of pixels has been refreshed, the scan line driver 4 enables the next row of pixels and the process is repeated until all of the lines of pixels have been refreshed. The process is then repeated for each frame of image data supplied in sequence to the display.

For a display having a frame refresh rate f and comprising a matrix of N by M pixels, the data rate frequency of the image data, for each colour in the case of a colour display, is fNM. Thus, the time available for refreshing each pixel is less than or equal to 1/fNM. The combined resistances of each transmission gate, each data line 8, and each pixel transistor 6 when conducting may amount to several kilohms and, together with the parasitic capacitance of the data line, the pixel storage capacitance and the liquid crystal capacitance, which may amount to several tens of picofarads, forms a time constant which must be sufficiently smaller than the pixel refresh period in order for the display to be properly refreshed. This places constraints on the size of the display and the frame refresh rate which can be achieved. Although it is possible to use multi-phase signals to perform concurrent point-at-a-time driving, the signal processing required to generate the required multi-phase display data signals is substantial.

For large displays where multi-phase point-at-a-time driving is unfeasible, line-at-a-time driving is used to allow substantially more time for data line charging. This technique may be used with analogue image data or with digital image data by providing digital-to-analogue conversion within the data line driver 2.

FIG. 2 of the accompanying drawings illustrates a display providing line-at-a-time driving with digital image data. The display comprises an active matrix 1 of pixels, for instance of the type shown in FIG. 1. The data line driver 2 of FIG. 1 is replaced by "top" and "bottom" digital data drivers 2*a* and 2*b* physically disposed above and below the active matrix 1. This is often necessary because of the large area required for the driver electronics. The drivers 2*a* and 2*b* drive respective sets of interleaved data lines 8*a* and 8*b*. The scan line driver 4 is of the same type as shown in FIG. 1 and supplies scan or strobe signals S1, . . . SN one at a time in a repeating sequence to the scan lines 7.

Each of the data drivers 2*a*, 2*b* comprises control logic 9*a*, 9*b* which receives control and synchronisation signals FPVDCK (flat panel video clock), FPDE (flat panel display enable) and HSYNC (horiztonal synchronisation) and which supplies the appropriate control signals to the remainder of the driver. Each of the drivers 2*a* and 2*b* comprises an input register 10*a*, 10*b*, a storage register 11*a*, 11*b* and a digital-to-analogue (D/A) converter array 12*a*, 12*b*. Each input register is connected to a colour data input bus receiving n digit image data for red, green and blue image pixels. Each converter array 12*a* and 12*b* receives gamma correction reference voltages which are used in D/A conversion to compensate for the liquid crystal voltage—transmission non-linearity. The scan line driver 4 receives the signals HSYNC and VSYNC (horizontal and vertical synchronising signals).

Red, green and blue image data, indicated by R (0:n−1), G(0:n−1) and B(0:n−1) in FIG. 2, are supplied as n bit parallel data with the data for the pixels being supplied sequentially. The input register 10*a*, 10*b* comprises a series shift register having a plurality of stages, each of which comprises a 3n bit register. The stages of the register 10*a*, 10*b* have parallel outputs connected to the storage register 11*a*, 11*b*, which comprises a number of 3n bit latches equal to the number of shift register stages.

The digital image data are entered a line at a time in the input register 10*a*. When a full line of data has been entered, the data are transferred from the input register 10*a*, 10*b* to the storage register 11*a*, 11*b*. A scan signal is applied to the scan line 7 of the row of pixels to be refreshed. The converter array 12*a*, 12*b* converts the image stored in the latches of the register 11*a*, 11*b* into the appropriate data voltages and supplies these to the data lines 8*a*, 8*b*. Thus, a complete line or row of pixels is updated at a time.

During updating of a row of pixels, image data for the next row of pixels are entered in the input shift register 10*a*, 10*b*. When the input register has received the complete row of image data, the image data are transferred to the storage register and the scan line driver 4 supplies a signal to the scan line 7 of the next row of pixels to be updated.

Using this technique, the pixels of each line or row are refreshed in a time equal to 1/fN. The refresh period for each pixel is therefore substantially greater than in the point-at-a-time driving technique. Thus, more time is available to allow data line charging using the line-at-a-time technique.

GB 2 323 958 and EP 0 869 471 disclose a technique which provides half-line-at-a-time driving by providing a data driver comprising two halves which successively perform data sampling and data line driving at line time frequency but half a line time ½fN out of phase with each other. When the first half of the data driver is sampling the image data, the second half of the driver is driving half a row of pixels. When the data has been sampled by the first half of the data driver, its mode of operation changes so as to drive the second half of the row of pixels. At the same time, the second half of the data driver starts sampling the image data.

The arrangement shown in FIG. 2 requires a memory, namely the input and storage registers 10*a*, 10*b*, 11*a*, 11*b*, with sufficient capacity to store two lines of image data.

The half-line-at-a-time driving arrangement reduces the memory requirement because only one line of image data has to be stored.

The large memory requirements for line-at-a-time driving as illustrated in FIG. 2 result in the need for the data driver to be commonly divided into the two halves and disposed above and below the active matrix 1. However, a disadvantage of this arrangement is the difficulty in matching the performances of the D/A converters in the arrays 12*a* and 12*b*. The difficulty is increased where such circuits are in the form of low-temperature polysilicon devices and the display size is large.

U.S. Pat. No. 5,604,511 discloses an arrangement which attempts to overcome this disadvantage by multiplexing the D/A converters within the data driver. In this arrangement, a signal converter is used to convert all of the digital image data into signal levels suitable for driving the display active matrix. However, this requires a D/A converter which is capable of operating at the pixel data rate frequency and which must therefore perform each conversion within 1/fNM second.

U.S. Pat. No. 5,170,158 discloses an arrangement in which D/A converters are multiplexed within the data driver so that there are fewer converters than pixels columns in the active matrix. In particular, each line of data is stored and converted to data line signals using time-multiplexing techniques so that each D/A converter performs the conversions for several pixels of image data per line. The arrangements shown in FIGS. 2 and 6 of U.S. Pat. No. 5,170,158 comprise four converters, each of which is connected to a shift register having a capacity for storing a quarter of a line of image data. The inputs of the shift registers are connected to a common image data input. In the arrangement shown in FIG. 10 of U.S. Pat. No. 5,170,158, a shift register stores a whole line of data and the converters receive data from latches for storing one pixel of image data. The latches are connected to consecutive stages of the line-capacity shift register. The arrangement shown in FIG. 12 of U.S. Pat No. 5,170,158 is similar to that of FIG. 10 but the shift register has a capacity for storing one fifth of a line of image data. The arrangement shown in FIG. 15 of U.S. Pat. No. 5,170,158 has a shift register which stores a whole line of image data. The converters are connected by a multiplexer to latches which are in turn connected to the shift register, the number of latches being equal to the number of shift register stages. In this arrangement, a memory capacity of two lines of image data is required. The arrangements shown in FIGS. 18 and 21 of U.S. Pat. No. 5,170,158 have a shift register with a capacity of one fifth of a line of image data. The converters are connected by a multiplexer to a set of latches, each of which is connected to a stage of the shift register and has a capacity for storing 5 pixels of image data. Accordingly, these arrangements require a storage capacity of one line of image data.

SUMMARY OF THE INVENTION

According to a first aspect of the invention, there is provided a data line driver for connection to M data lines of a matrix display, comprising x data line circuits whose inputs are connected to a common input for receiving a serial image signal, where x is less than M, characterised in that each of the data line circuits comprises: a store for storing one picture element of image data at a time; a multiplexer for storing in the store in sequence image data for m picture elements from at least part of a line of image data, where m is greater than one; and a demultiplexer for directing a line signal corresponding to the image data stored in the store to each of m of the M data lines in sequence.

Such an arrangement requires fewer converters and less digital memory capacity than the known arrangements, for instance described hereinbefore. In particular, x converters are required and a memory capacity of only x pixels of image data is necessary. Thus, fewer components and less area of circuit integration are required. This provides a driver having reduced power consumption, improved yield and reduced cost.

In many implementations, such an arrangement avoids the need to provide the top and bottom drivers illustrated in FIG. 2 of the accompanying drawings. Because the driver components can be manufactured with more uniformity over a smaller geometrical area, the accuracy of D/A conversion and buffering, where present, can be improved. This in turn provides improved display image quality. Also, fabrication is facilitated because the data lines at the edges of the matrix opposite the data driver can be grounded to protect active matrix TFTs during a liquid crystal rubbing phase in the manufacture of an AMLCD.

The m picture elements and the m data lines may be non-adjacent for at least some of the x data line circuits. By arranging the driver in this way, the time between successive operations of each data line circuit can be increased. For instance, where the data line circuits have D/A converters, the maximum permissible conversion time can be increased so that a conversion can be performed more accurately. Also, more time can be made available for charging data lines from reference voltages as in certain types of D/A converters. Where arrangements of this type have a transmission gate associated with each data line, the transistors of the transmission gates may be made much smaller while achieving the required refresh rate.

The m data lines may comprise (n+ik)th data lines, where n is a first predetermined integer, k is a second predetermined integer which is not a multiple of m, and i represents a set of m consecutive integers. Apart from the data drivers at the row ends, such an arrangement allows the same arrangement of lateral routing between the data line circuits and the data lines.

k may be equal to 5.

Each store may comprise a digital store. Each of the data line circuits may comprise a digital-to-analogue converter between the store and the demultiplexer.

Each demultiplexer may comprise m transmission gates.

Each demultiplexer may have m outputs connected to m storage circuits and buffers. In one arrangement, each storage circuit may comprise a first capacitor, a first switch for connecting a respective one of the demultiplexter outputs to the first capacitor, a second capacitor connected to the input of the buffer, and a second switch for connecting the first capacitor to the second capacitor. In another arrangement, each storage circuit may comprise first and second capacitors and a switching arrangement which, in a first switching state, connects the first capacitor to a respective one of the demultiplexer outputs and the second capacitor to the input of the buffer and which, in a second switching state, connects the second capacitor to the respective one of the demultiplexer outputs and the first capacitor to the input of the buffer.

The multiplexer of each data line circuit may comprise the store and a control circuit for controlling the timing of storing image data from the common input.

m may be equal to 3. In one arrangement, the common input may have red, green and blue sub-inputs and the input of each data line circuit may be connected to one of the sub-inputs. In another arrangement, the common input may have red, green and blue sub-inputs and each data line circuit may have a further multiplexer whose inputs are connected to the sub-inputs.

Each data line circuit may comprise m output switches for enabling connection of the demultiplexer to the m data lines, the output switches being arranged as groups which are enabled alternately.

According to a second aspect of the invention, there is provided a matrix display comprising a driver in accordance with the first aspect of the invention.

The display may comprise a liquid crystal display.

The display may comprise an active or passive matrix display.

BRIEF DESCRIPTION OF THE DRAWINGS

The invention will be further described, by way of example, with reference to the accompanying drawings, in which.

DETAILED DESCRIPTION OF THE INVENTION

Figure 1:
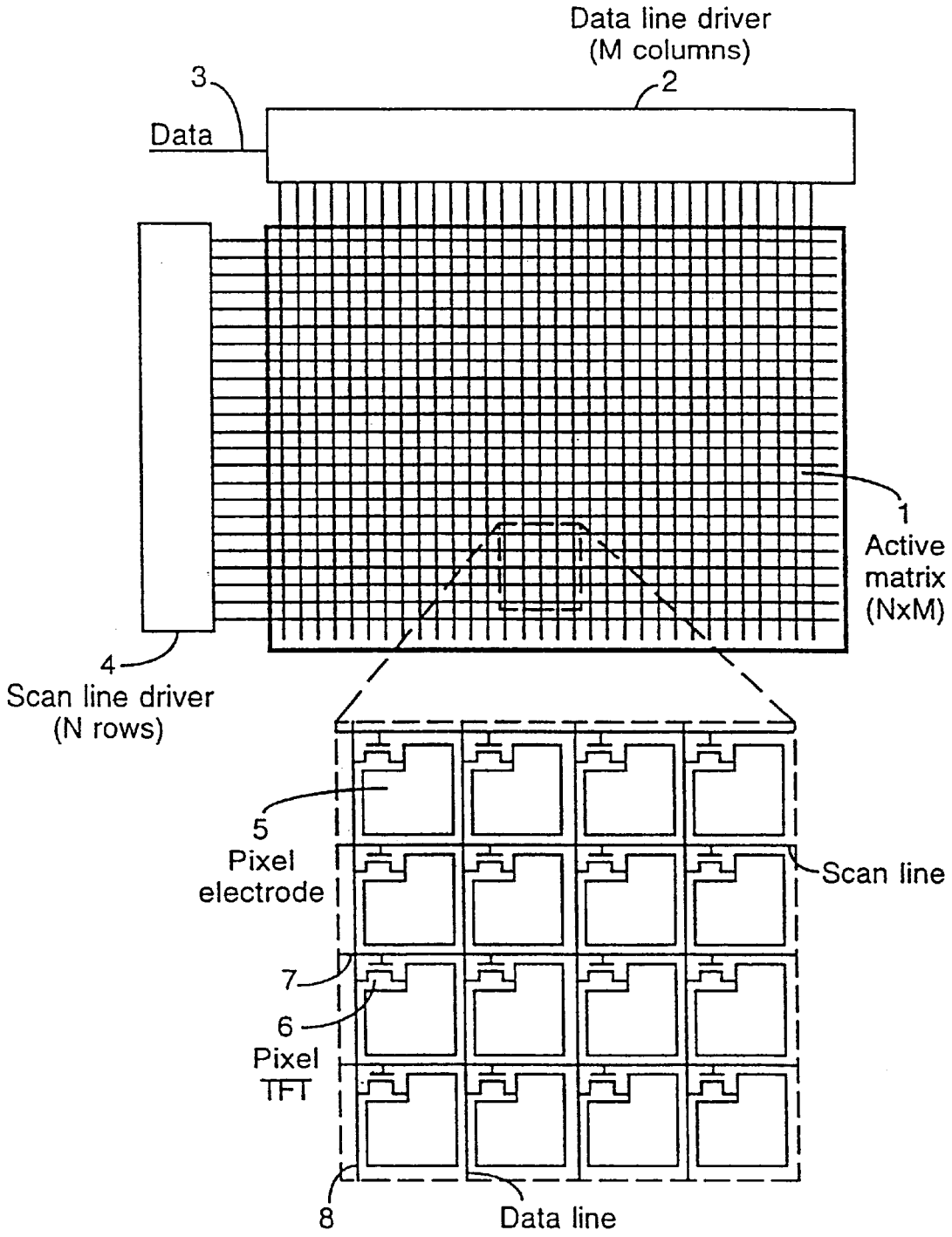
Fig.1. PRIOR ART
FIG. 1 is a block schematic circuit diagram of a first known type of active matrix display.

Like reference numerals refer to like parts throughout the drawings.

Figure 3:
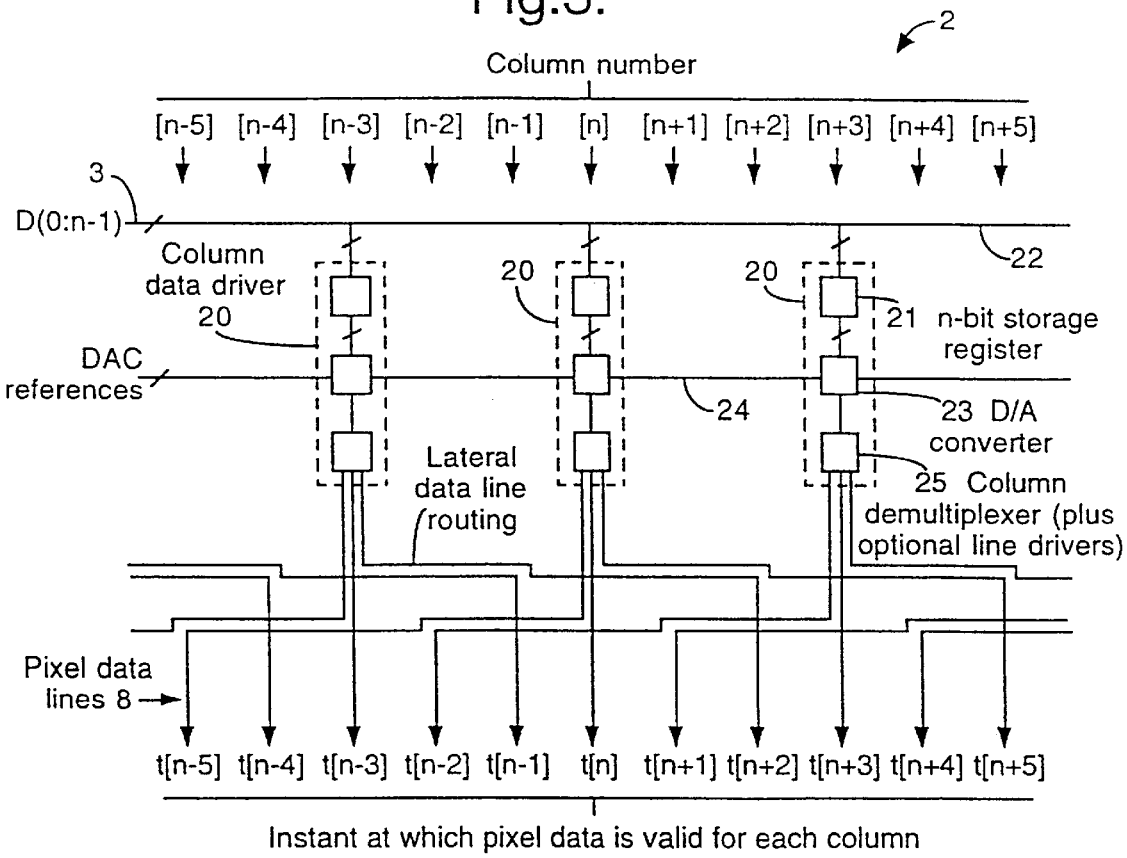
FIG. 3 is a schematic circuit diagram illustrating part of a data line driver and an active matrix display constituting a first embodiment of the invention.

FIG. 3 illustrates the circuit layout of a data line driver 2 constituting an embodiment of the invention. The column numbers of the pixel columns and data lines are shown at the top of FIG. 3 for a part of an active matrix and the associated data line driver circuits away from the ends of the pixel row or line. Parallel n bit digital image data D(0:n−1) are supplied serially to a common input 3 and the common input is connected to a plurality of data line circuits or column data drivers 20. Each circuit 20 comprises a parallel n bit storage register or latch 21 having n parallel inputs connected via an n bit data bus 22 to the common input 3. The n bit parallel outputs of the storage register 21 are connected to the inputs of a D/A converter 23 which receives common reference voltages or currents for the conversion process from a line 24 which is common to all of the circuits 20. The output of the converter 23 is connected to the input of a column demultiplexer 25 whose outputs may be provided with line drivers and which are connected to the data lines 8 of the display active matrix.

The data line driver 2 is arranged to drive M pixel column data lines 8, only some of which are shown in FIG. 3. The driver 2 comprises M/m circuits 20, where m is equal to 3 in the arrangement shown by way of illustration. Thus, apart from the circuits 20 required at the row ends, the number of column data drivers 20 is reduced to a third of what would be required in conventional arrangements.

The storage registers 21 and the converters 23 are effectively spaced along the display matrix at m column intervals and each operates m times during each line refresh time. The column demultiplexers 25 have m outputs connected to respective pixel column scan lines 8 spaced in such a way as to increase the available time for register sampling and D/A conversion operations by a factor of k pixel data periods by lateral spacing of the connections by k columns, where k is equal to 5 in the illustrated arrangement shown in FIG. 3. For instance, the circuit 20 associated with the [n]th column has a first demultiplexer output connected to supply pixel refresh image data at time t[n] to the [n]th column data line. The second demultiplexer output of the same driver 20 supplies pixel refresh data a time t(n−5) to the [n−5]th column data line. The third demultiplexer output of the same circuit 20 supplies pixel refresh data at time t(n+5) to the data line of the [n+5]th column data line. Thus, the time available for each storage and D/A conversion operation for each of the circuits 20 is equal to 5 pixel data periods (5/fMN.

In order for the same lateral routing to be adopted for the connections between each circuit 20 and the data lines which it drives, k should not be a multiple of m. Because of the finite length of each line or row of pixels, the routing for the circuits 20 at the row ends is different from that away from the row ends. However, a large reduction in the number of circuits 20 is achieved and the data storage requirements are reduced to M/m pixels of image data.

Figure 4:
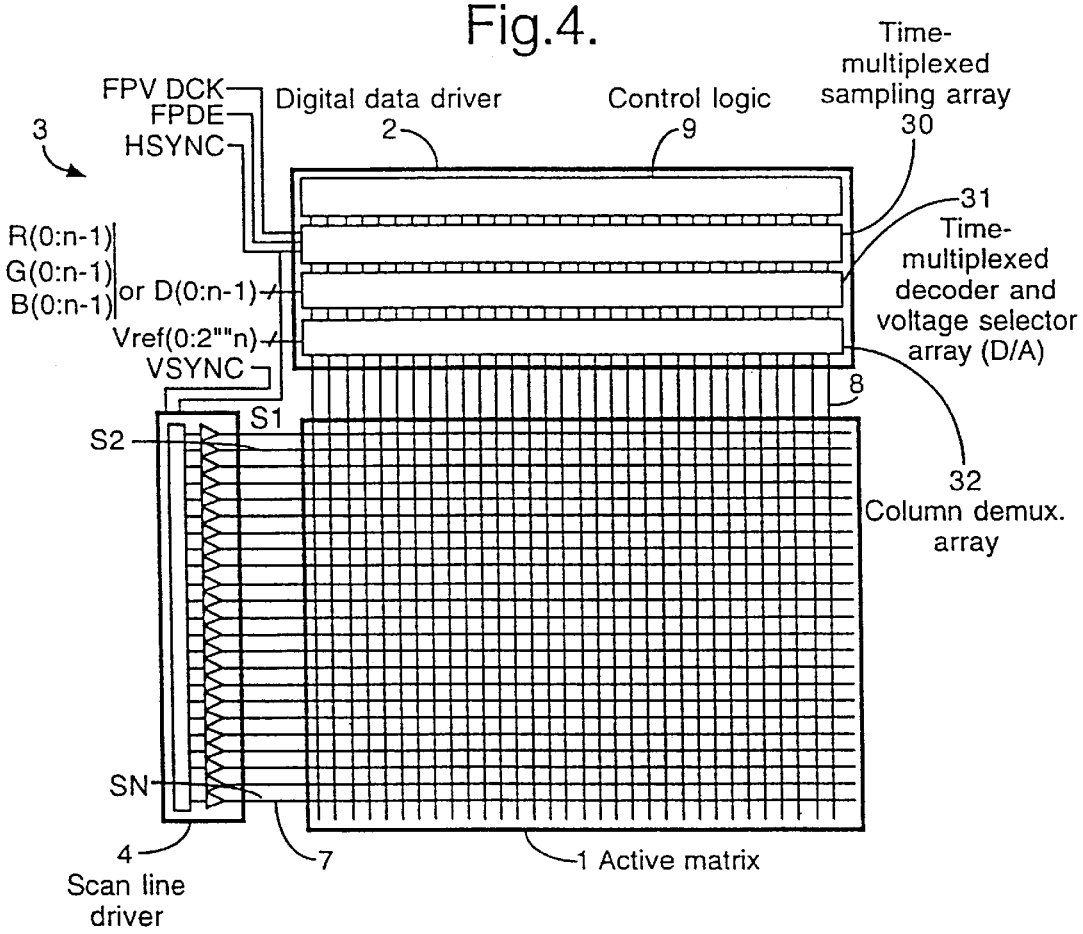
FIG. 4 is a block schematic circuit diagram of an active matrix display constituting a second embodiment of the invention.

FIG. 4 illustrates the arrangement of a relatively low resolution display including a digital data driver 2 of the type illustrated in FIG. 3 for concurrent point-at-a-time driving. By way of example, the display is of the active matrix type but the driver 2 may equally well be used in a passive matrix type of display. The active matrix 1 may, for example, be a colour or monochrome reflective liquid crystal display where the relatively low contrast ratio ability requires relatively few data bits per pixel. The driver 2 includes the control logic 9, for instance described hereinbefore and shown in FIG. 2. The storage registers 21 in association with the control logic 9 form a time-multiplexed sampling array 30 such that each register 21 under control of the control logic 9 acts as a multiplexer for storing in the register in sequence the pixel image data which are to be supplied to the appropriate scan lines 8 of that driver circuit 20. The D/A converters 23 are arranged as a time-multiplexed decoder and voltage selector array 31 and the column demultiplexers 25 are arranged as an array 32.

Figure 2:
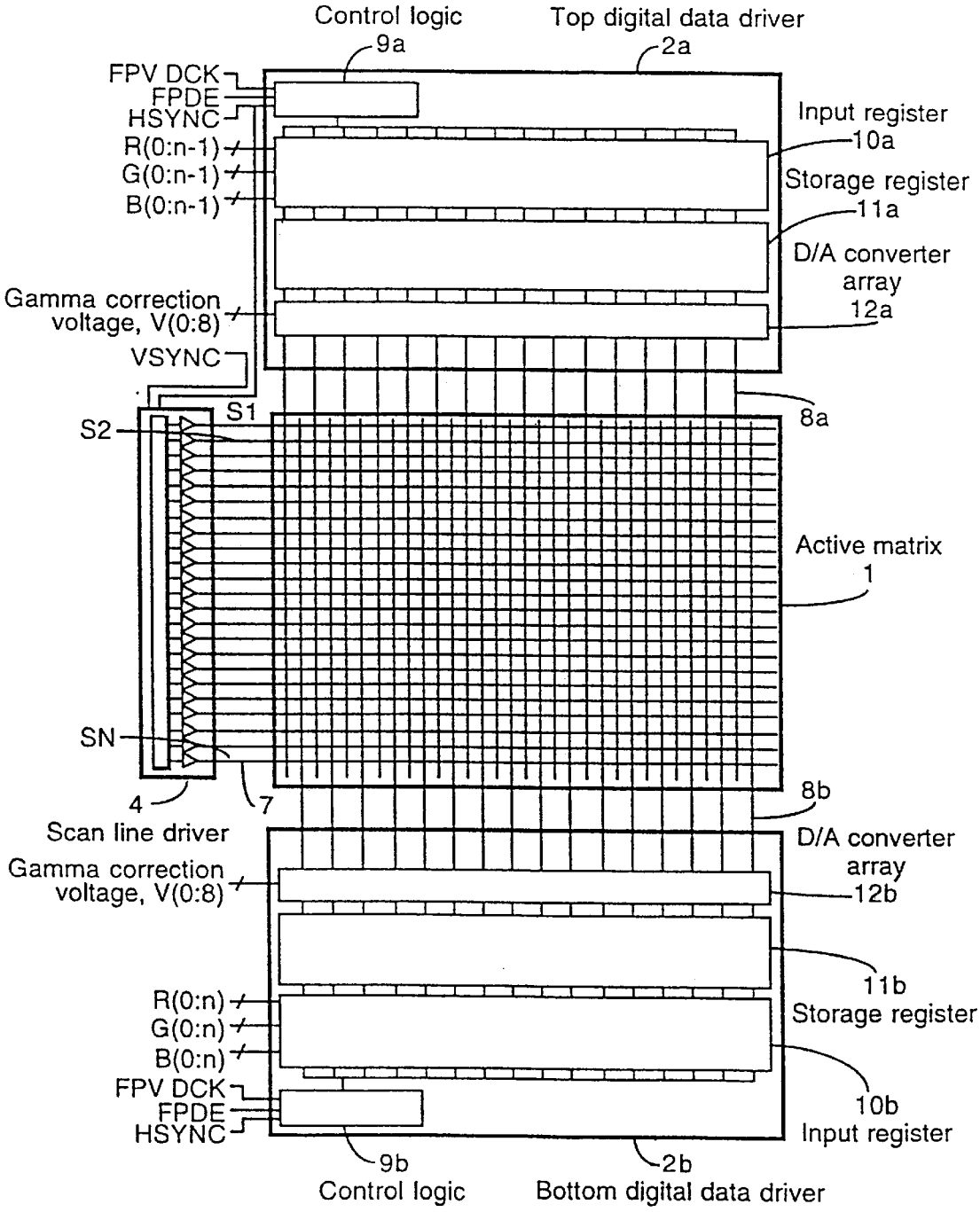
Fig.2. PRIOR ART
FIG. 2 is a block schematic circuit diagram of a second known type of active matrix display.

In order to permit a comparison, the height of the data driver 2 in FIG. 4 is drawn to approximately the same scale as the drivers 2*a* and 2*b* in FIG. 2. This illustrates the reduction in integration area and hence in the number of components which can be achieved in a typical embodiment of the present invention.

Figure 5:
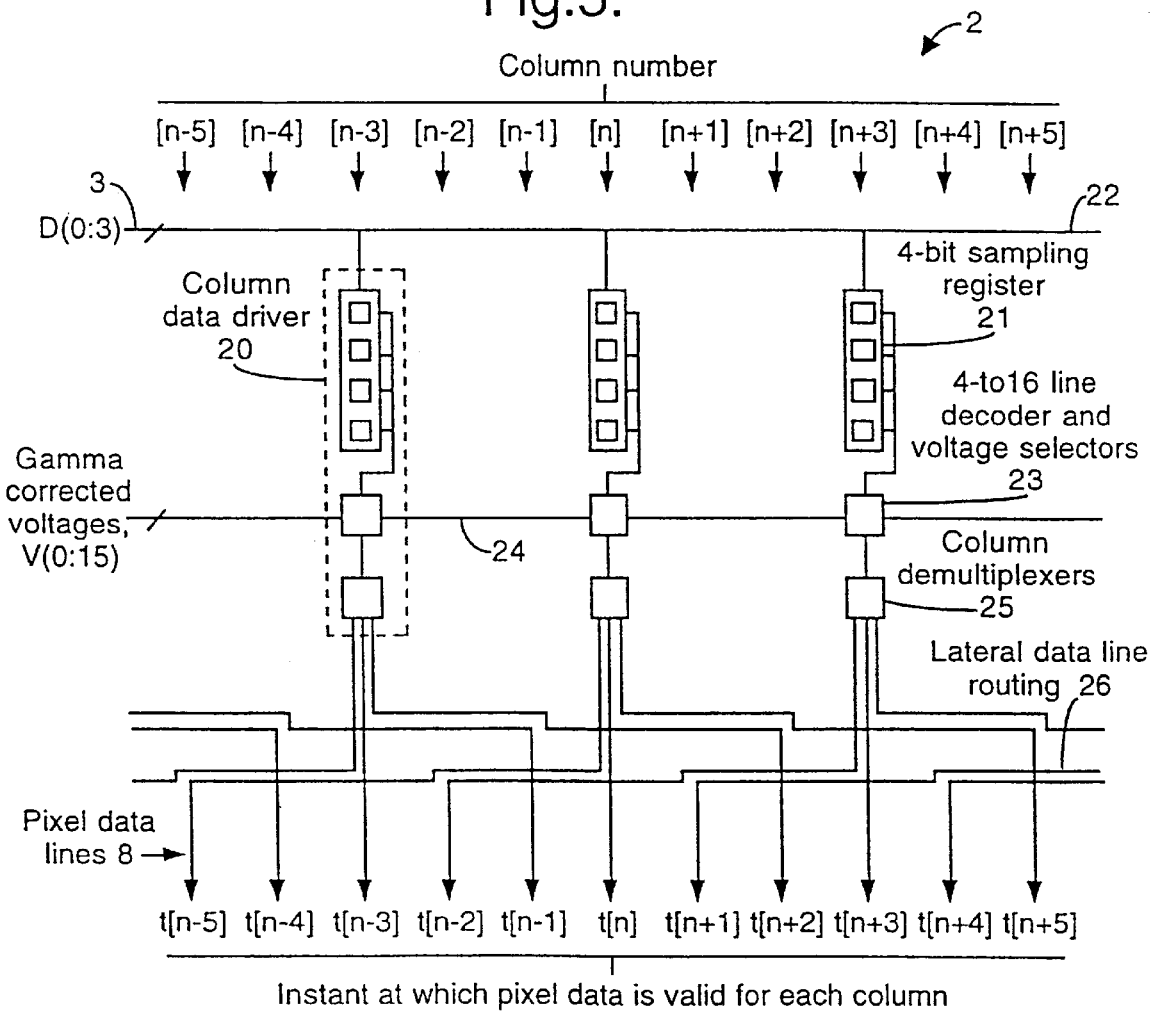
FIG. 5 is a schematic circuit diagram illustrating part of the display of FIG. 4.

FIG. 5 illustrates a typical arrangements of the column data driver circuits 20 for use in the display of FIG. 4. The registers 21 comprise parallel in/parallel out 4 bit registers connected to a 4 bit data bus 22 which, in this case, receives monochrome serial image data. The outputs of each register 21 are connected to a 4-to-16 line decoder and voltage selector which constitutes the D/A converter 23. The output of the decoder and selector 23 is supplied to the column demultiplexer 25 and thence by the lateral data line routing 26 to the pixel column data lines 8.

As described hereinbefore with reference to FIG. 3, the column data driver circuits 20 are multiplexed three times such that m is equal to 3 and the number of driver circuits 20 is approximately one third the number of pixel column data lines 8. However, other degrees of multiplexing may be used and, for instance, by multiplexing the driver circuits 2 four times such that each is connected to four pixel data lines 8, there would be a factor of four times fewer driver circuits 20 than pixel columns.

Again, the lateral data line routing 26 has been chosen such that k is equal to 5. Thus, the adjacent pairs of columns to which each column demultiplexer 25 is connected are spaced apart by five pixel columns so that five pixel data periods are available for each conversion operation. However, k may be chosen to be any desired number and, provided it is not a multiple of m, the lateral data line routing 26 for each of the driver circuits 20 other than those at the ends of the pixel row will be the same.

Figure 6:
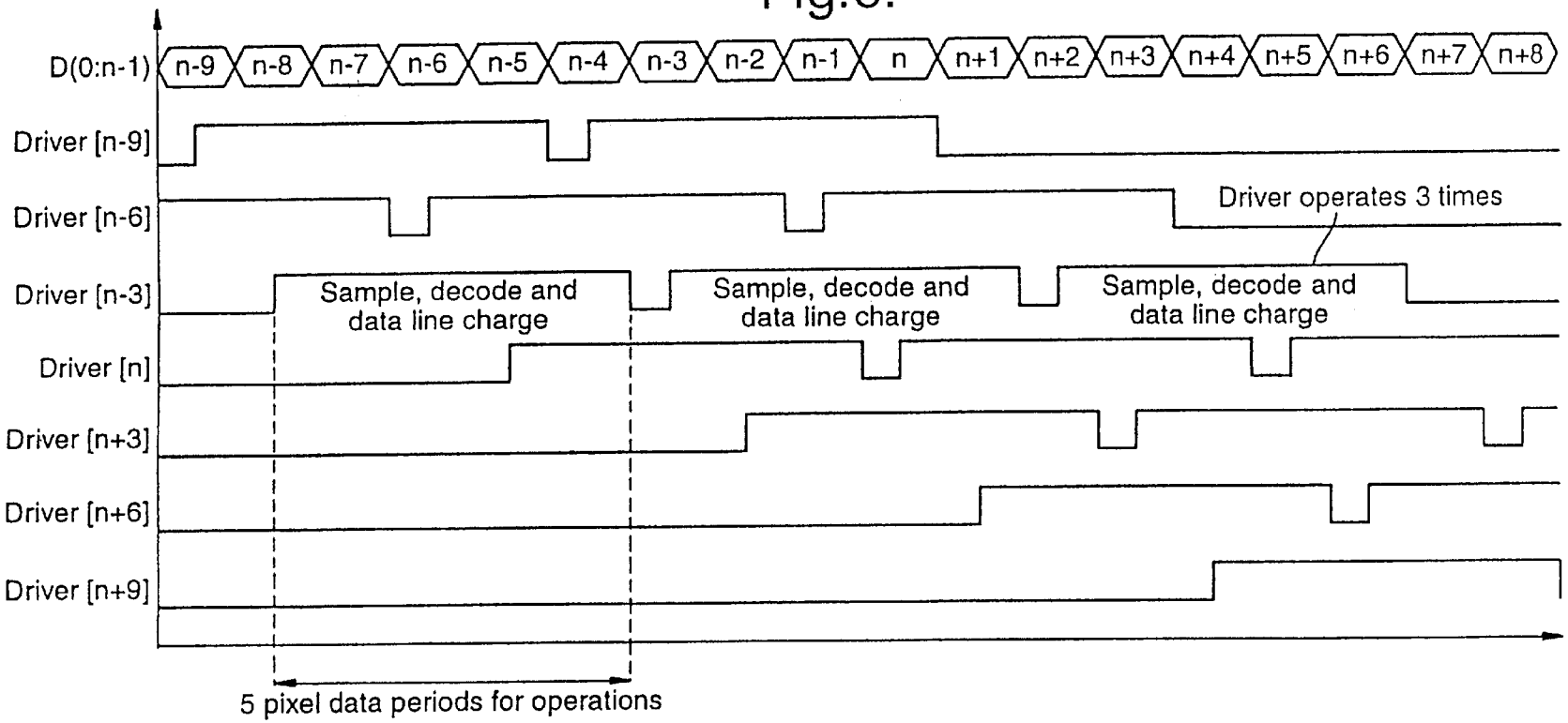
FIG. 6 is a timing diagram illustrating operation of the display of FIG. 4.

FIG. 6 is a timing diagram illustrating operation of the driver circuits 20 as shown in FIG. 5. The driver circuits are identified by the column number shown in FIG. 5 above each circuit 20. For instance, the driver circuit associated with column [n−3] begins a data line driving operation when the pixel image data for a pixel in the [n−8]th column is present on the 4 bit data bus 22. This driver circuit is not required to begin another conversion operation until the image data for the [n−3]th pixel of the row is present on the data bus 22. Thus, the driver circuit 20 has, in theory, five pixel data periods to perform the operation of sampling the pixel data, decoding the data into a suitable signal for the corresponding data line and charging the data line. In practice, the total period may be less than five pixel data periods but at least four pixel data periods should be available for each conversion operation.

Also as illustrated in FIG. 6, each driver circuit 20 operates 3 times (m=3). However, as mentioned hereinbefore, the driver circuits 20 may be more highly multiplexed in order to reduce the number of driver circuits 20 at the expense of increasing the lateral data line routing complexity.

Figure 7:
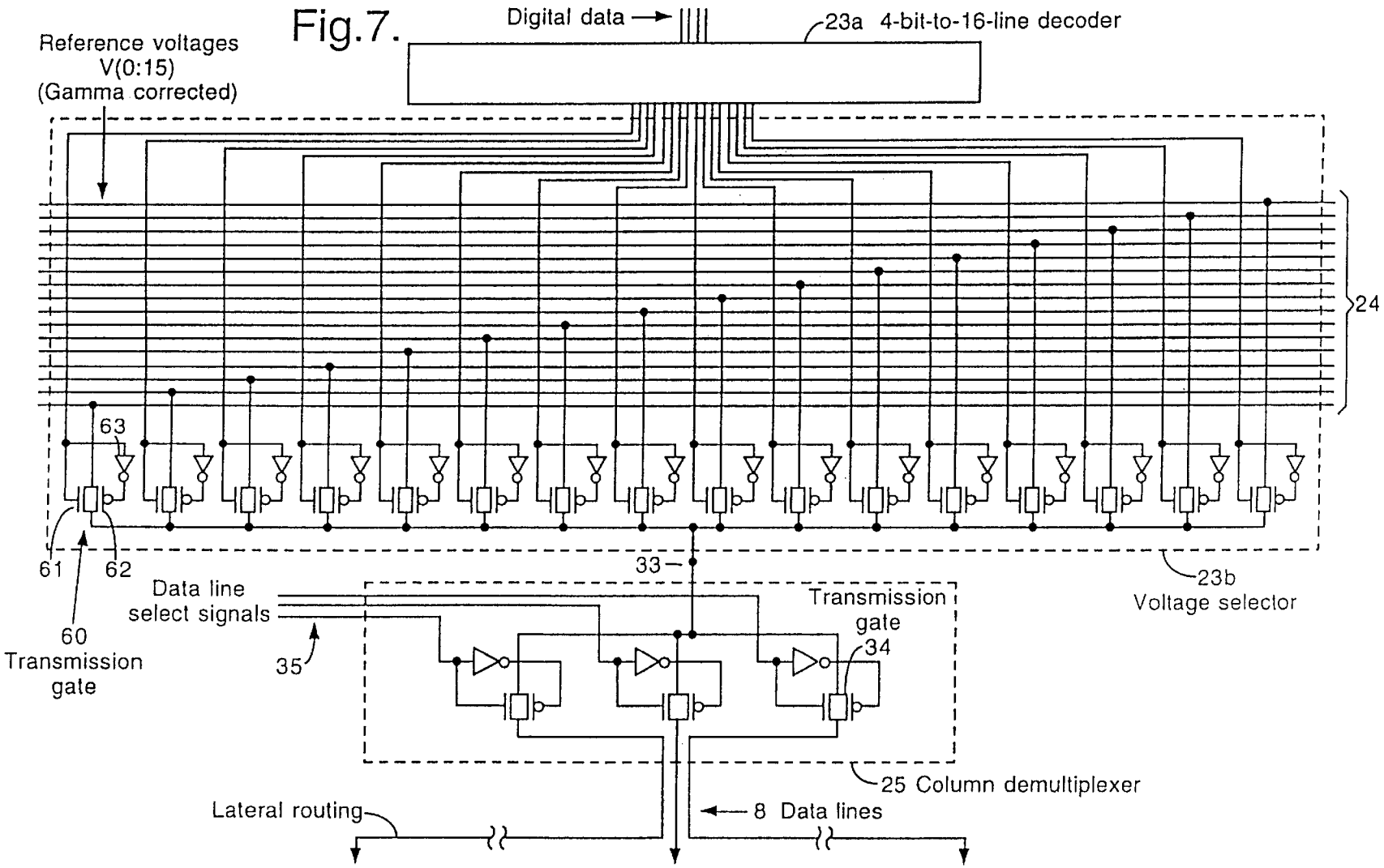
FIG. 7 is a schematic circuit diagram illustrating another part of the display of FIG. 4.

FIG. 7 illustrates in more detail a specific example of a converter 23 and demultiplexer 25 for one of the driver circuits 20. The D/A converter comprises a 4-bit-to-16 line decoder 23*a* which receives the 4 bit pixel data from the register 21 and energises one of its sixteen outputs in accordance with the binary number represented by the digital data.

The outputs of the decoder 23*a* are connected to a voltage selector 23*b* which comprises sixteen transmission gates such as 60, each of which is controlled by a respective one of the decoder outputs. Each of the transmission gates 60 comprises two parallel complementary transistors 61, 62, one of whose gates receives the control signal directly and the other of whose gates receives the control signal via an inverter 63. Each transmission gate is connected between a respective one of sixteen gammna-corrected reference voltage lines forming the bus 24 and an output 33 of the voltage selector 23*b*. Thus, the energised output of the decoder 23*a* determines which of the voltages present on the bus 24 is supplied to the output of the D/A converter.

The demultiplexer 25 comprises three transmission gates such as 34 controlled by data line select signals supplied to a control input 35 of the demultiplexer 25. Each of the transmission gates 34 is connected between the output 33 of the voltage selector 23*b* and a respective one of the three data lines 8 with which the driver circuit 20 is associated.

Thus, by enabling one of the lines connected to the input 35 of the demultiplexer 25, the output of the converter is connected to one of the data lines 8.

The data lines 8 are charged through two serially-connected transmission gates, namely one 60 in the voltage selector 23*b* and another 34 in the column demultiplexer 25. These gates must be carefully switched in order to minimise charge injection on the data lines 8.

Figure 8:
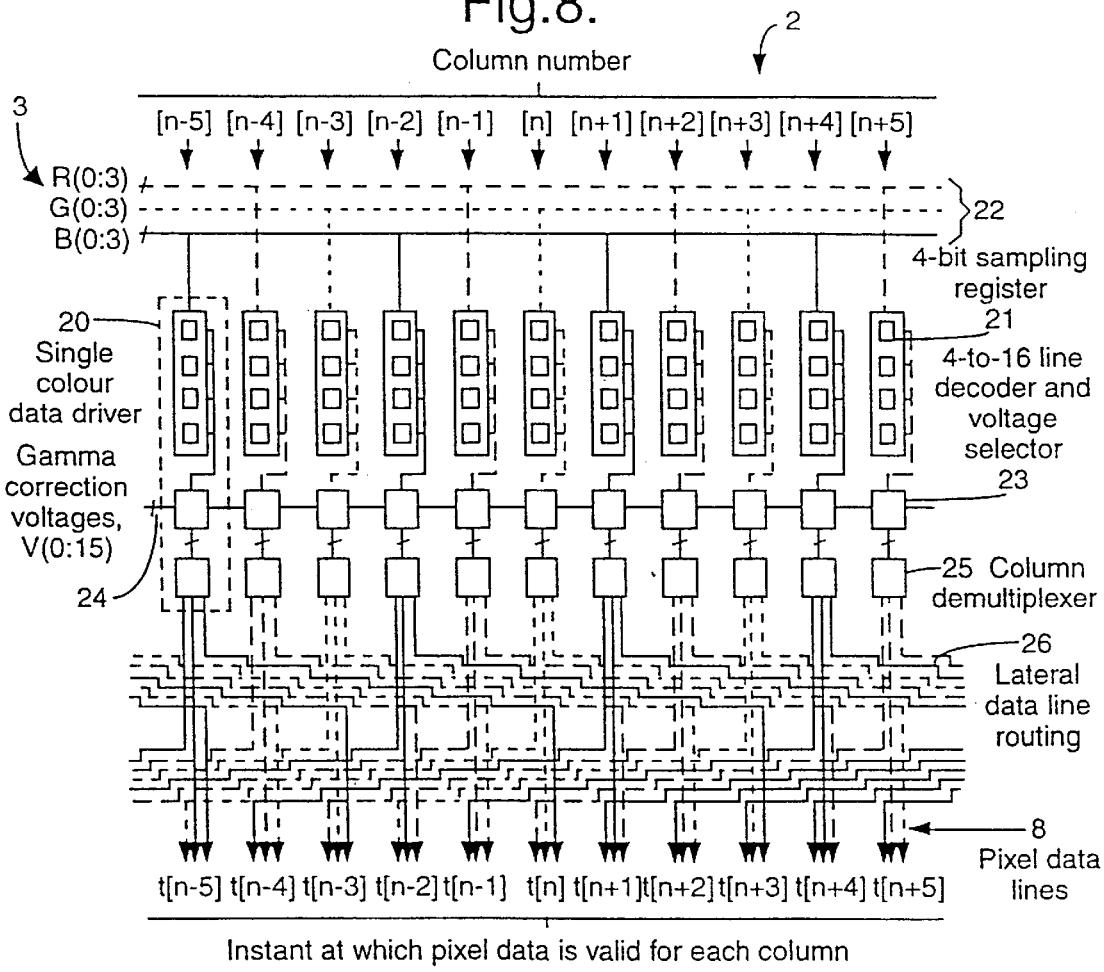
FIG. 8 is a schematic circuit diagram of part of a display constituting a third embodiment of the invention.

FIG. 8 illustrates a 4 bit colour or RGB digital data driver which is essentially of the same type as that shown in FIG. 5. However, the column data driver circuits 20 are replicated for each colour so that there are M such circuits for M data lines 8. Again m is equal to 3 and k is equal to 5.

Each of the driver circuits 20 receives 4 bit data from one of three data buses 22 connected to the common input 3. Thus, each driver circuit 20 handles a single colour for three data lines 8 spaced apart by five pixel columns. The buses 22, the connections within each driver circuit 20, the lateral data line routing 26 and the pixel data lines 8 are shown as solid lines for blue, dotted lines for green and dashed lines for red.

At the time t(n), the red, green and blue data on the RGB buses 22 are for the pixel in the [n]th column. The driver circuit 20 for the [n]th column drives the green data line, the [n−5]th driver circuit 20 drives the blue data line, and the [n+5]th circuit 20 drives the red data line of the [n]th column data line 8.

Figure 9:
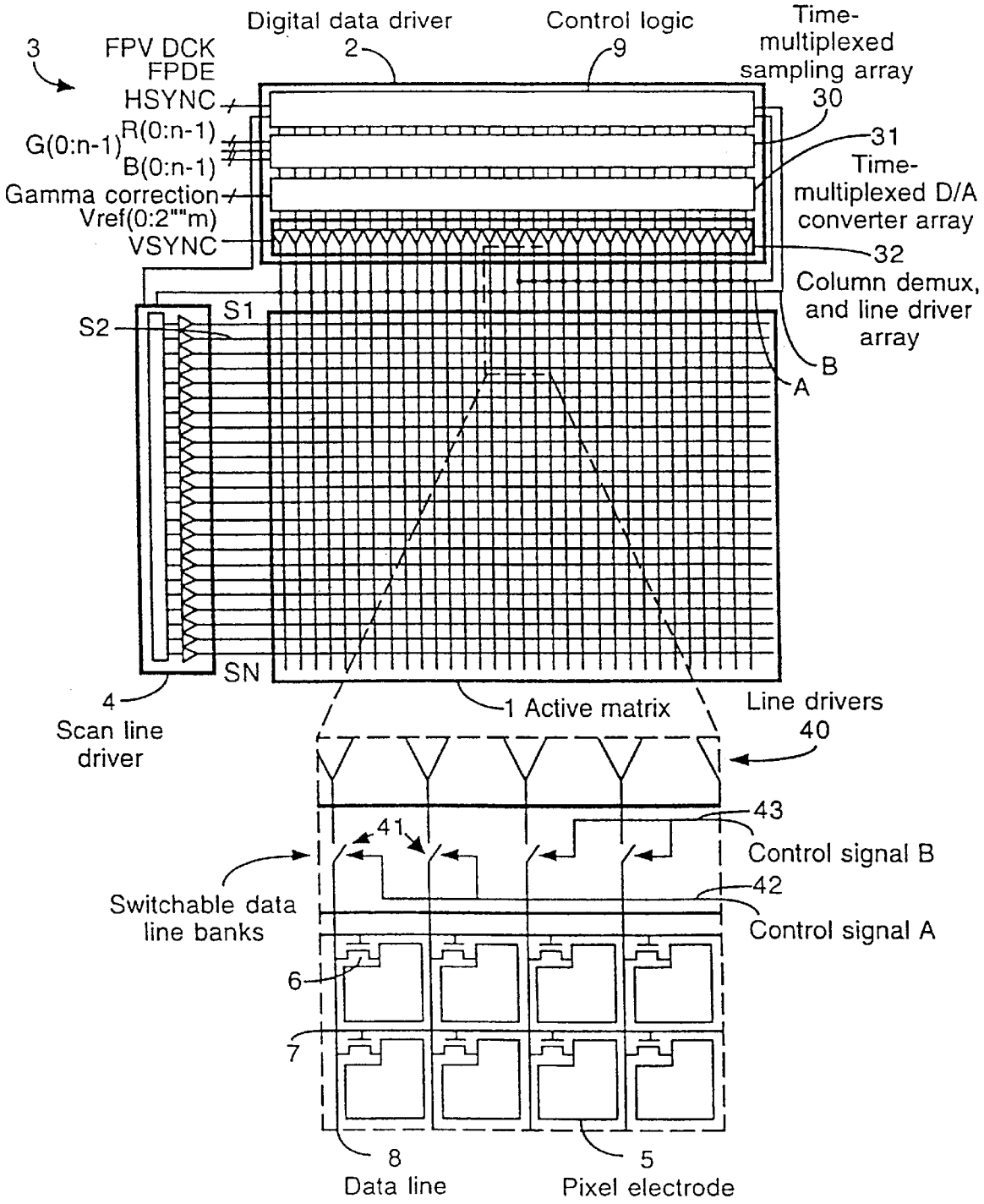
FIG. 9 is a block schematic circuit diagram of a display constituting a fourth embodiment of the invention.

FIG. 9 illustrates a high bit-resolution colour display of a similar type to that shown in FIG. 4 but embodying the half-line-at-a-time driving technique disclosed in GB 2 323 958 and EP 0 869 471. The array 32 includes a respective line driver 40 for driving each data line 8 via a switch 41. The switches 41 for the data lines 8 of the first half of the row in the active matrix 1 have control inputs connected together and via a control line 42 to receive a control signal A. The switches 41 for the second half of the row have control inputs connected to a common control line 43 for receiving a control signal B. The control signals A and B are supplied by the control logic 9.

Figure 10:
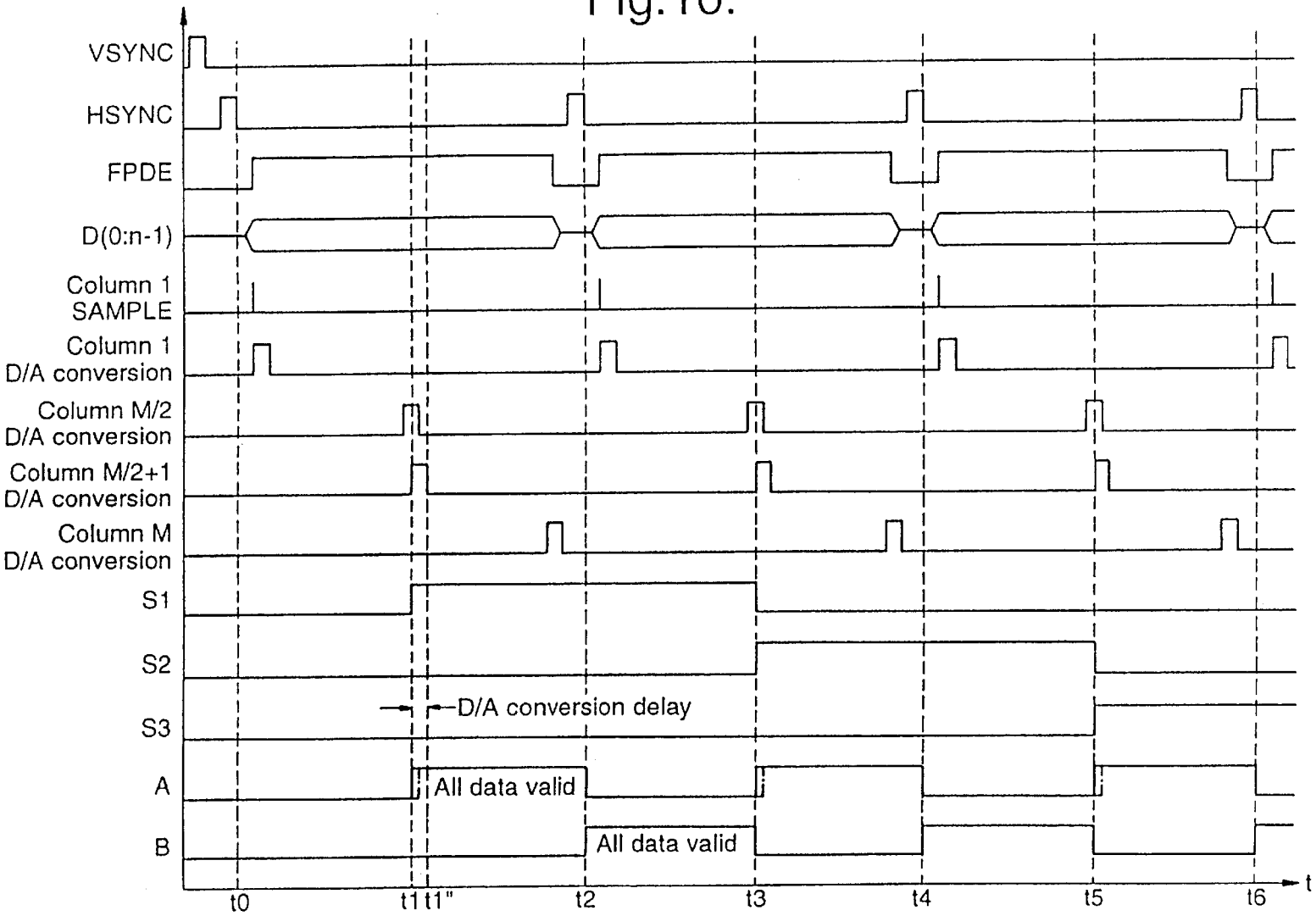
FIG. 10 is a timing diagram illustrating operation of the display of FIG. 9.

Operation of the display shown in FIG. 9 is illustrated by the waveform diagrams shown in FIG. 10. The switches 41 are activated to connect the respective drivers 40 to the data lines 8 when the control signal A or B is at a high level. Otherwise, the switches 41 are opened to disconnect the line drivers 40 from the data lines 8. FIG. 10 shows the vertical and horizontal synchronising signals, the flat panel display enable (FPDE) signal, the sampling signal for column 1 of the active matrix 1 (the left hand column) and the D/A conversion time periods for columns 1, M/2, M/2+1 and M. The first three strobe signals S1, S2 and S3 are also shown together with the switch control signals A and B.

The falling edge of the horizontal synchronising signal at time t0 occurs immediately before the image data for the pixel row being refreshed. The first half of the row or line data is sampled between time t0 and time t1. At time t1, the scan signal S1 for the first row and the control signal A go high so that the switches 41 in the driver circuits 20 for the data lines 8 in columns 1 to M/2 are activated and the corresponding pixels of the first half of the row are refreshed.

During the same period, the image data for the second half of the row are sampled and converted by the driver circuits 20 for columns M/2+1 to M. At time t2, the control signal A goes low so that the driver circuits 20 for the first half of the row are disconnected from the data lines 8. The control signal B goes high at the same instant so that the remaining driver circuits are connected to the corresponding data lines. The strobe signal S1 is still high so that the pixels in the second half of the first row are refreshed. Refreshing of the complete row finishes at time t3. The strobe signal S1 goes low, the strobe signal S2 for the next line goes high and the process is repeated.

The digital/analogue conversion delay is illustrated in FIG. 10. At time t1, the scan line receiving the strobe signal S1 and the control signal A are activated. Between the time t1 and the time t2, digital/analogue conversion and data line charging must be completed for all of the data lines 8 of the half row. In the example illustrated, all of the conversions are completed by time t1" so that this constraint is satisfied.

Figure 11A:
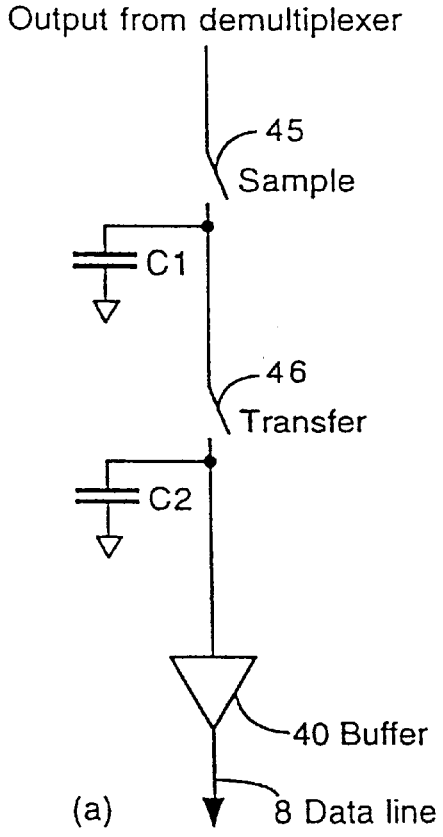
FIGS. 11*a* and 11*b* are schematic circuit diagrams illustrating analogue storage arrangements.
Figure 11B:
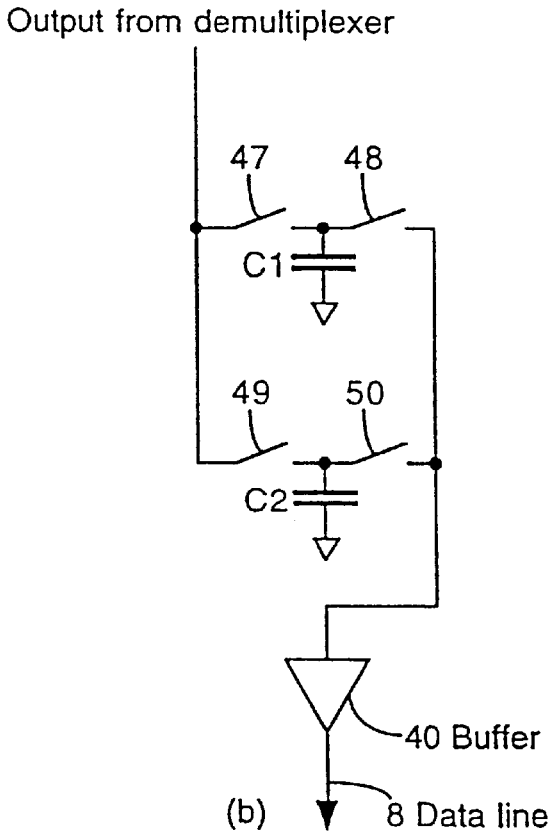

In order to perform line-at-a-time driving as described hereinbefore, each driver circuit 20 requires extra analogue memory and two examples of storage circuits for this purpose are illustrated in FIGS. 11*a* and 11*b*. The storage circuit is connected between the demultiplexer output and the corresponding data line 8. The analogue storage circuits allow the output from each demultiplexer 25 to be sampled while the line driver or buffer 40 is simultaneously driving the data line 8 with pixel data from the preceding image line.

The storage circuit shown in FIG. 11*a* comprises first and second capacitors C1 and C2 and first and second switches 45 and 46. The capacitor C1 is connected by the switch 45 to the output of the demultiplexer 25 to sample the output signal while the charge stored in the capacitor C2 drives the input of the buffer 40. In order to transfer the "data" in the capacitor C1, the switch 46 is closed so that the charges on the capacitors C1 and C2 are shared and C2 then supplies the fresh "data" to the buffer 40. Switch 46 can then be opened again and the switch 45 closed to transfer the next sample.

FIG. 11*b* shows an alternative arrangement in which two capacitors C1 and C2 are used as storage elements but are controlled by switches 47 to 50. The switches 47 and 50 are controlled so as to be open or closed in synchronism with each other, as are the switches 48 and 49. Thus, while one of the capacitors C1 and C2 is being charged from the output of the demultiplexer via the corresponding switch 47 or 49, the capacitor is disconnected from the buffer 40 whereas the other capacitor controls the buffer.

Figure 12:
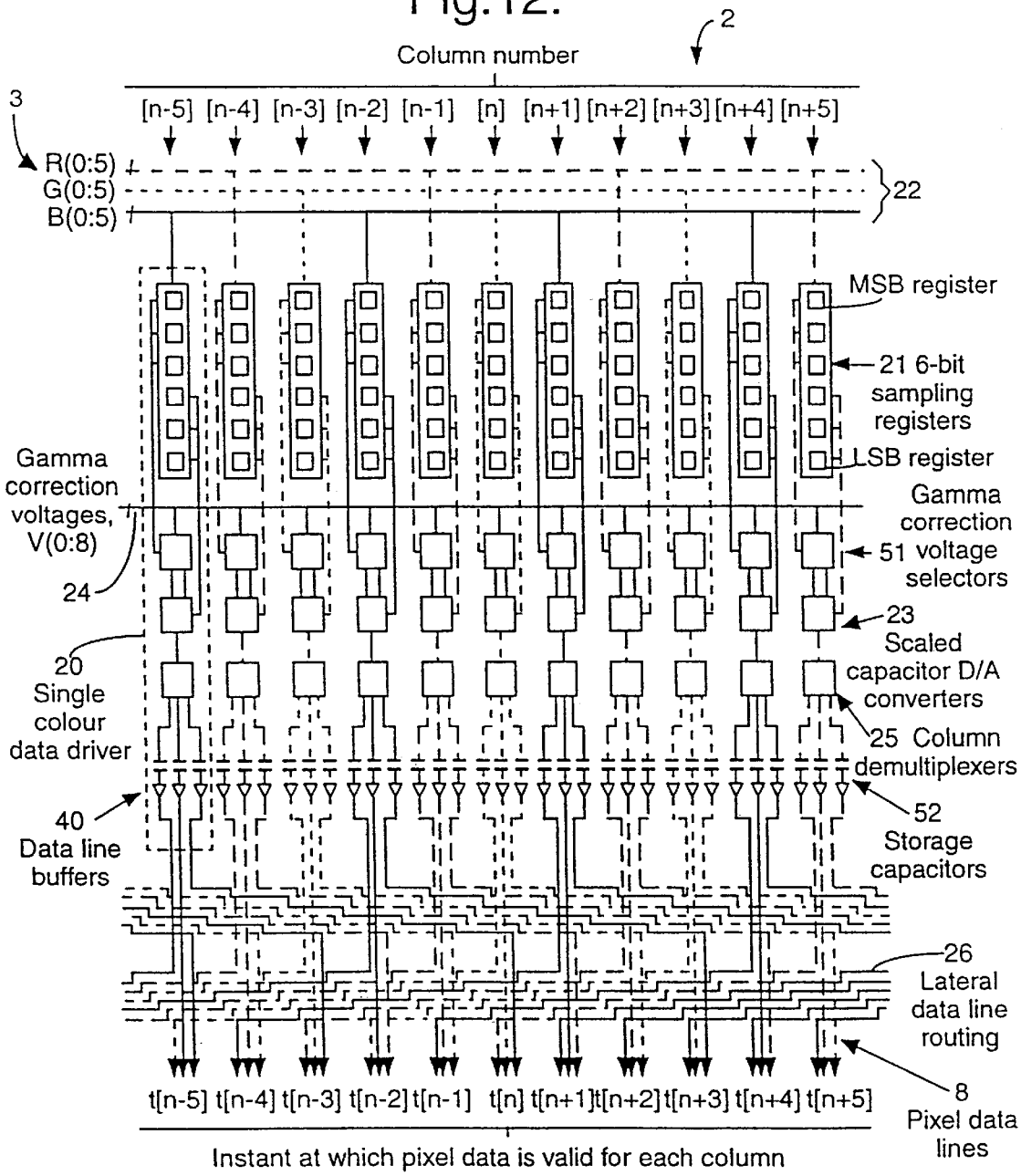
FIG. 12 is a block schematic diagram illustrating part of a display constituting a fifth embodiment of the invention.

FIG. 12 illustrates a high bit-resolution colour display of a type similar to that shown in FIG. 8 such that each column data driver circuit 20 operates for a single colour. Each of the colour component signals has a grey scale capability of 6 bits so that the registers 21 comprise 6 bit parallel in/parallel out registers or latches.

The display of FIG. 12 further differs from that of FIG. 8 in that digital/analogue conversion is performed by scaled capacitor converters 23 controlled by the three least significant bits of the register 21 and a gamma correction voltage selector 51 controlled by the three most significant bits of the register 21. Thus, the most significant bits of each pixel data select the gamma correction reference voltages which define a range within which a lower resolution digitavanalogue conversion is performed by the converter 23.

The display of FIG. 12 incorporates storage circuitry of the type illustrated in FIGS. 11*a* and 11*b* and this is indicated diagramatically by the storage capacitors 52 connected to the data line buffers 40. Thus, the digital data driver 2 shown in FIG. 12 operates using the line-at-a-time driving technique as described hereinbefore. However, if the display of FIG. 12 is required to operate using the half line-at-a-time driving technique as described hereinbefore, simpler storage circuitry may be used, for instance comprising a single storage capacitor and a buffer for each data line.

Figure 13:
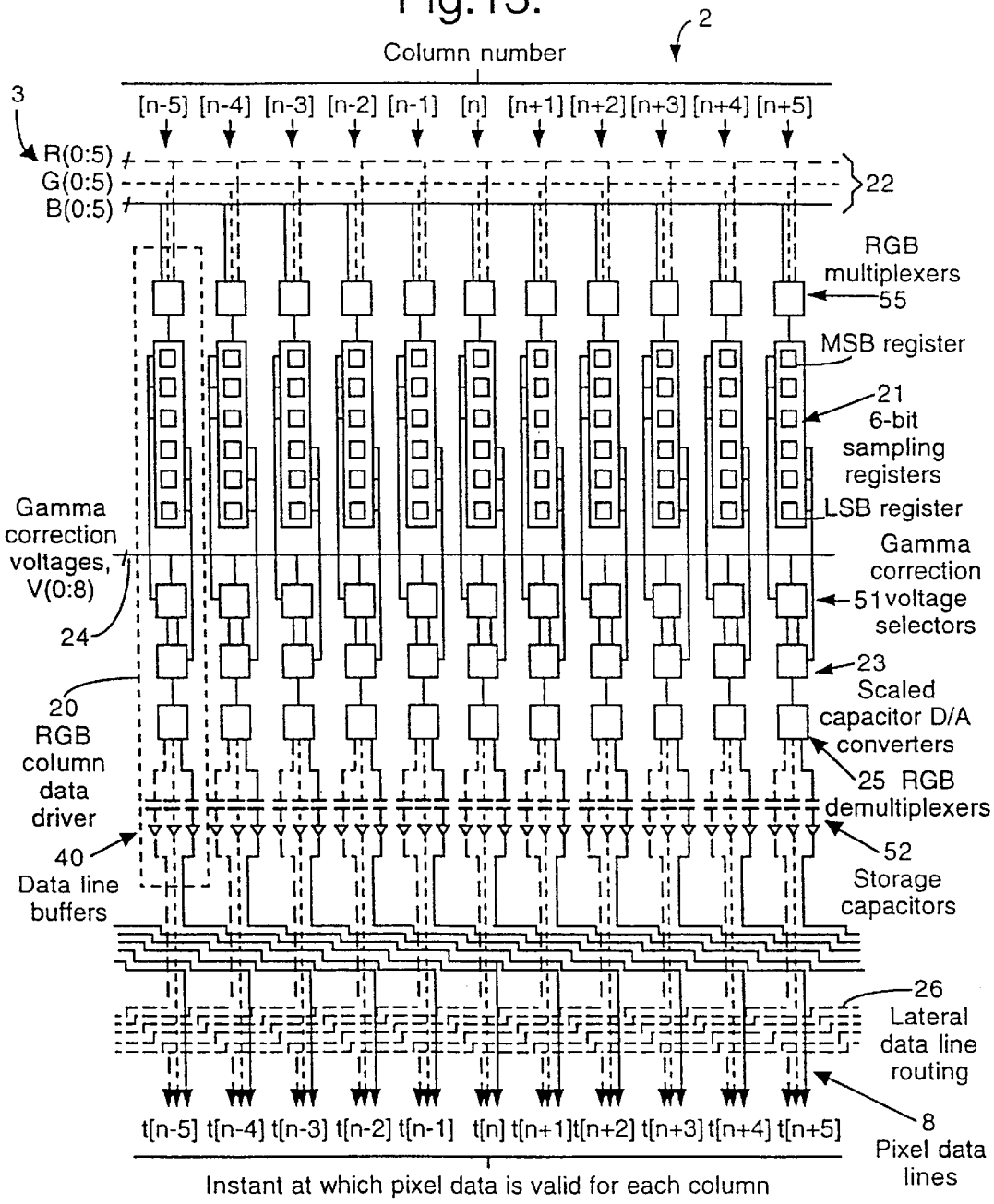
FIG. 13 is a block schematic circuit diagram of part of a display constituting a sixth embodiment of the invention.

FIG. 13 illustrates a display and data line driver 2 which differ from those in FIG. 12 in that each column data driver circuit 20 performs red, green and blue conversion. Thus, each driver circuit 20 is connected to the three colour data buses 22 through an RGB multiplexer 55. The multiplexers 55 ensure that the driver circuits 20 sample data from the correct bus. Thus, at time t(n), the driver circuit 20 of the column [n−5] samples the blue data bus, the driver circuit 20 of the column [n] samples data on the green data bus and the driver circuit 20 of the column [n+5] receives data from the red data bus.

As compared with the arrangement shown in FIG. 12, the data line driver 2 of FIG. 13 requires extra circuitry in the form of the multiplexers 55. However, the lateral data line routing 26 is slightly simplified.

What claimed is:

1. A data line driver for connection to M data lines of a matrix display, comprising x data line circuits whose inputs are connected to a common input for receiving a serial image signal, where x is less than M, wherein each of the data line circuits comprises:

a store for storing one picture element of image data at a time;

a multiplexer for storing in the store in sequence image data for m picture elements from at least part of a line of image data, where m is greater than one; and a demultiplexer for directing a line signal corresponding to the image data stored in the store to each of m data lines of the M data lines in sequence.

2. A driver as claimed in claim 1, wherein the m picture elements and the m data lines are non-adjacent for at least some of the x data line circuits.

3. A driver as claimed in claim 2, wherein the m data lines comprise (n+ik)th data lines, where n is a first predetermined integer, k is a second predetermined integer which is not a multiple of m, and i represents a set of m consecutive integers.

4. A driver as claimed in claim 3, wherein k is equal to five.

5. A driver as claimed in claim 1, wherein each store comprises a digital store.

6. A driver as claimed in claim 5, wherein each of the data line circuits comprises a digital-to-analog converter between the store and the demultiplexer.

7. A driver as claimed in claim 1, wherein each demultiplexer comprises m transmission gates.

8. A driver as claimed in claim 1, wherein each demultiplexer has an output connected to m storage circuits and buffers.

9. A driver as claimed in claim 8, wherein each storage circuit comprises:

a first capacitor;

a first switch for connecting a respective one of the demultiplexer outputs to the first capacitor;

a second capacitor connected to the input of the buffer; and a second switch for connecting the first capacitor to the second capacitor.

10. A driver as claimed in claim 8, wherein each storage circuit comprises first and second capacitors and a switching arrangement which, in a first switching state, connects the first capacitor to a respective one of the demultiplexer outputs and the second capacitor to the input of the buffer and which, in a second switching state, connects the second capacitor to the respective one of the demultimplexer outputs and the first capacitor to the input of the buffer.

11. A driver as claimed in claim 1, wherein the multiplexer of each data line circuit comprises the store and a control circuit for controlling the timing of storing image data from the common input.

12. A driver as claimed in claim 1, wherein m is equal to three.

13. A driver as claimed in claim 12, wherein the common input has red, green and blue sub-inputs and the input of each data line circuit is connected to one of the sub-inputs.

14. A driver as claimed in claim 12, wherein the common input has red, green and blue sub-inputs and each data line circuit has a further multiplexer whose inputs are connected to the sub-inputs.

15. A driver as claimed in claim 1, wherein each of the data line circuits comprises m output switches for enabling connection of the demultiplexer to the m data lines, the output switches being arranged as groups which are enabled alternately.

16. A matrix display comprising:

a display region including a plurality of pixels connected to a plurality of data lines and a plurality of scan lines;

a data line driver for driving the data lines; and a scan line driver for driving the scan lines;

wherein the data line driver is one according to claim 1.

17. A display as claimed in claim 16, wherein the display comprises a liquid crystal display.

18. A display as claimed in claim 16, wherein the display comprises an active matrix display.

* * * * *